US006913156B1

(12) United States Patent
Wolff

(10) Patent No.: US 6,913,156 B1
(45) Date of Patent: Jul. 5, 2005

(54) ORGANIZING SYSTEM FOR DRAWERS AND CABINETS

(75) Inventor: Robert A. Wolff, Selinsgrove, PA (US)

(73) Assignee: Wood-Mode Incorporated, Kreamer, PA (US)

( * ) Notice: Subject to any disclaimer, the term of this patent is extended or adjusted under 35 U.S.C. 154(b) by 0 days.

(21) Appl. No.: 10/397,929

(22) Filed: Mar. 26, 2003

(51) Int. Cl.[7] ..... A47F 5/00
(52) U.S. Cl. ..... 211/184; 312/148.3; 211/43
(58) Field of Search ..... 312/348.1, 348.2, 312/348.3, 330.1, 321; 211/184, 182, 43, 211/11; 220/592.05; 248/200.1, 906; 403/187, 403/188, 192, 193, 195, 197, 199, 200

(56) References Cited

U.S. PATENT DOCUMENTS

| | | | | |
|---|---|---|---|---|
| 2,463,407 | A * | 3/1949 | Melton | 285/149.1 |
| 2,925,977 | A * | 2/1960 | Cononi | 248/62 |
| 2,927,807 | A * | 3/1960 | Campbell | 285/154.1 |
| 2,974,806 | A * | 3/1961 | Seewack | 211/123 |
| 3,530,997 | A * | 9/1970 | Djorup | 211/184 |
| 3,951,269 | A * | 4/1976 | Anderson | 211/105.4 |
| 4,302,024 | A * | 11/1981 | Weddle | 280/47.33 |
| 4,653,714 | A * | 3/1987 | Andrasko, Jr. | 248/251 |
| 4,830,201 | A | 5/1989 | Breslow | |
| 5,009,539 | A * | 4/1991 | Muellenberg | 403/370 |
| 5,072,880 | A * | 12/1991 | McCloud | 273/108.52 |
| 5,746,741 | A * | 5/1998 | Kraus et al. | 606/54 |
| 5,775,523 | A | 7/1998 | Teringo | |
| 5,894,610 | A * | 4/1999 | Winter | 4/558 |
| 6,299,004 | B1 | 10/2001 | Thalenfeld et al. | |
| 6,357,958 | B1 * | 3/2002 | Geib et al. | 403/369 |
| 6,431,333 | B1 * | 8/2002 | Glodich | 190/110 |
| 6,629,506 | B2 * | 10/2003 | Park | 108/156 |

FOREIGN PATENT DOCUMENTS

| | | |
|---|---|---|
| IT | 000586 | 3/1998 |

OTHER PUBLICATIONS

Hafele America Co., Catalog Data Sheets—8.1-8.12 pages.
Rutt Handcrafted Cabinetry, Five (5) Photos of Self Organizing Product, Designated as Rutt "A".
Rutt Handcrafted Cabinetry, Six (6) Photos of Shelf Organizing Product, Designated as Rutt "B".

(Continued)

*Primary Examiner*—Peter M. Cuomo
*Assistant Examiner*—Stephen D'Adamo
(74) *Attorney, Agent, or Firm*—Caesar, Rivise, Bernstein, Cohen & Pokotilow, Ltd.

(57) ABSTRACT

An organizing system for drawers and cabinets for attachment to opposing walls is disclosed which includes at least one main support that includes a pair of holes in the opposing walls. The pair of holes are in opposing alignment with one another. The system further includes a pair of attachment pins. Each pin is pressed into one of the pair of holes in the walls. The head of the pin has a top surface. A primary support rod having two ends extends between the top surfaces of the heads of the pair of attachment pins such that an abutment point is created at each end of the primary support rod between each primary support rod end and the top surface of each attachment pin. Fittings slide over the abutment point to secure the primary support rod with respect to each attachment pin.

10 Claims, 7 Drawing Sheets

OTHER PUBLICATIONS

Hafele America Co., Photo from Brochure of Shelf Organizing System, Designated as Hafele "A".
Amerock Corp., Photo of CD Storage Unit for Shelving, Designated as Amerock "A".
Amerock Corp., Photo of CD Storage Unit, Designated as Amerock "B".
Amerock Corp., Photo of CD Shelf or Drawer System, Designated as Amerock "C".
Amerock Corp., Photo and Discovery of CD Shelf or Drawer System, Designated as Amerock "D".
Rutt Handcrafted Cabinetry, Two (2) Photos from Website (as noted) of Pull-out Shelf Organizing System, Designated as Rutt "C".
Julius Blum, Inc., "More Space For Good Ideas"*Brochure*, date unknown, pp. 1-35.

* cited by examiner

FIG. 7
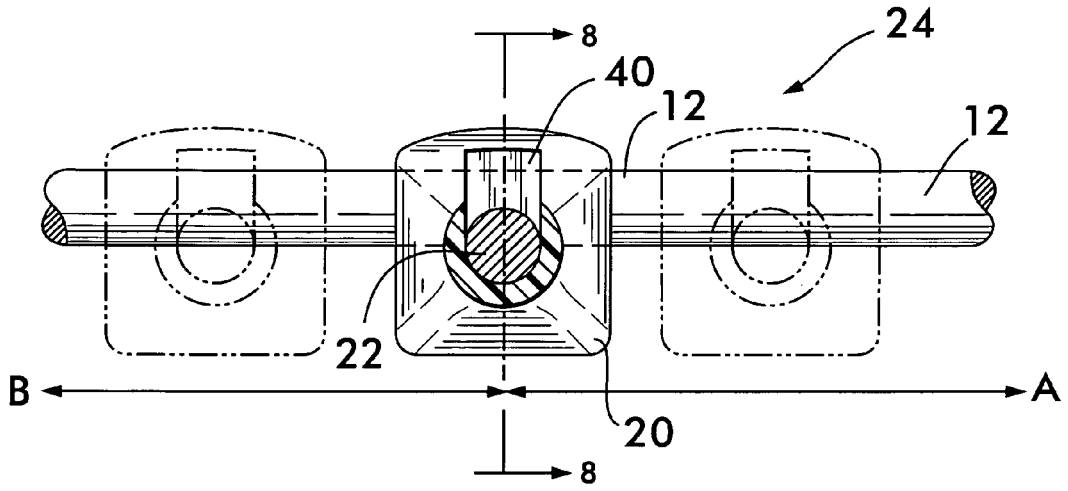
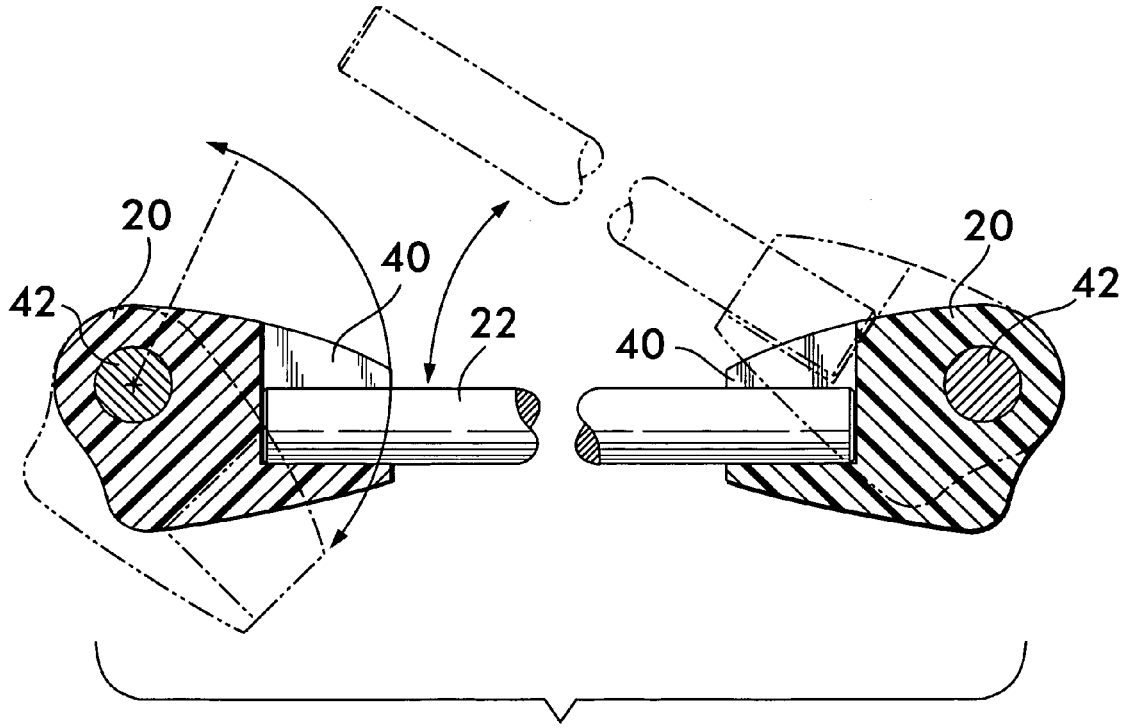
FIG. 8

ORGANIZING SYSTEM FOR DRAWERS AND CABINETS

BACKGROUND OF THE INVENTION

The present invention is directed to drawer, cabinet and shelf organizing systems, and, more particularly, to a system for subdividing horizontal storage shelves and drawers into compartments having vertical braces.

Shelving and drawers are usually designed and manufactured for several purposes, rather than being dedicated to a single purpose. For this reason, it is typically not feasible to provide structure subdividing each shelf into suitable or appropriate compartments for any one particular situation. Shelving and drawers may be provided with integral, permanent partitions for subdividing the shelf, drawer, or equivalent horizontal supporting surface into compartments. However, in most instances, such partitions are either not adjustable, or are arranged to subdivide the shelf into compartments which are excessively small.

One example of shelves which are frequently susceptible to the need for selective partitioning is food storage shelves. Unlike parts storage bins utilized to store numerous types of small fasteners and other small articles, food storage cabinets may be required to store articles of vastly differing dimensions and configurations. Containers may be rectangular, cylindrical, long, short, small, large, etc. Many other types of shelves also require selective partitioning. Food storage shelves are merely one example where such partitioning is desirable.

Organizing, separating and grouping such articles enables ready retrieval of each particular item or type of item. The prior art has suggested various devices for such uses. These prior art devices include various frames that are inserted into drawers or shelves.

For example, U.S. Pat. No. 6,299,004 (Thalenfeld et al.) teaches a shelf organizing system for dividing flat shelving. An extruded front rail member of an L-shaped configuration is secured to the front of the shelf, providing a vertical barrier wall. A retention channel is formed integrally with the front rail member. Divider elements, extruded in continuous lengths and cut to a desired length for a particular shelf width are formed with a vertical flange and a horizontal stabilizing flange. The stabilizing flange is inserted in the retention channel at any point along its length and is tightly gripped to hold the divider element in any desired position.

U.S. Pat. No. 5,775,523 (Teringo) is directed to a modular shelf organizer for partitioning a shelf. The organizer includes a plurality of trays, each having a floor and four short upright walls, and a fence for spanning adjacent trays. The fence forms a storage compartment between two trays and prevents stored items from rolling off the shelf. The fence has one or more fence members that have a short wall with slots. Corresponding slots are formed in the right and left walls of the tray. Fence members are attached by friction and gravity.

U.S. Pat. No. 4,830,201 (Breslow) discloses a shelf divider system having a divider wall mountable in a channel member secured to the front of the shelf. A spring-urged pusher member is slidably mounted on a track having a pair of rails integral with the divider shaft.

Italian Patent No. 1,298,650 is directed to a frame for stabilizing a group of containers. The figures of this patent depict two devices for mounting support bars that span between walls of a drawer or shelf system. FIGS. 1–4 of this Italian patent depict an open U-shaped bracket 24 into which the main support bar 14 is lowered at each end of the support bar. It is noted that the device 34 of FIG. 1 does not appear to be related to the function of the bracket 24. FIGS. 6 and 7 depict an entirely different mounting system in which support bars 16 are lowered into U-shaped grooves in side brackets 20.

Another prior art system by Rutt Handcrafted Cabinetry utilizes a right angle connector adapted to connect cylindrical metal rods at right angles to one another. Two short rods are inserted (by a friction fit) into separate holes on the surface of the shelf such that they each protrude vertically and perpendicular to the shelf. A right angle connector is connected to each short rod, and a relatively long metal rod is horizontally fixed between the two right angle connectors such that a horizontal barrier prevents objects from falling off the shelf. This system requires dedicated fixation to the shelf. Moreover, the horizontal bar is not adjustable. Finally, while the shelf is vertically adjustable, the bar travels with the shelf at a fixed relation.

Another similar system by Rutt Handcrafted Cabinetry to that described above uses the same right angle connectors that secure metal rods at right angles. The difference between this system and that described previously is the vertical rods are somewhat longer and one or more vertically adjustable horizontal bars attach to the vertical rods below the fixed horizontal bar by the use of sliding connectors. Again, while the shelf is vertically adjustable, the system here travels with the shelf. Here, user access can be restricted if the shelf above the shelf to which this system is mounted is positioned too close to the fixed horizontal bar. Due to the relatively long vertical rods and the fact that the rods are attached to a single shelf, this system may tend to flex laterally at the top, especially when loaded with stored items.

A common prior art system includes one or more u-shaped rods or wires that are pushed into holes on the top of a shelf. This simple system utilizes the bent rods as dividers for various objects such as compact disc packages.

Other prior art systems include molded plastic spacers that are adapted to hold compact discs or similar items. These systems must be custom manufactured to fit in shelf openings or shelf openings must be adjustable to accommodate a stock size of this item. Again, these systems are not adjustable to accommodate different size packages. They also are limited in size and application. Systems such as these are made by, for example, Amerock division of Newell Rubbermaid.

Finally, Hafele Corporation makes plastic audio/video media storage systems that are mounted to the surface of a shelf. These systems are rail system that are nonadjustable and sized to fit, for example, videotapes, compact disk cases and audio cassette tape packaging.

None of the above systems, taken either singly or in combination, describes the instant invention, as claimed. Specifically, all of the prior art systems are limited in size, scope, flexibility and accommodation.

All references cited herein are incorporated herein by reference in their entireties.

BRIEF SUMMARY OF THE INVENTION

The present invention provides a drawer and shelf organizing system of exceptional simplicity and economy in which numerous standard elements may be used. Where custom sizing is required, standard sizes can be manufactured in continuous lengths and then easily cut to length appropriate to the application.

The present invention is directed to an organizing system for drawers and cabinets for attachment to opposing walls, adjacent a flat shelf or drawer bottom, which includes at least one main support that uses a pair of holes in the opposing walls. The holes are in opposing alignment with one another. The system further includes a pair of attachment pins. Each pin is pressed into one of the pair of holes in the walls. The head of the pin has a top surface. A primary support rod, having two ends, extends between the top surfaces of the heads of the pair of attachment pins such that an abutment point is created at each end of the primary support rod between each primary support rod end and the top surface of each attachment pin. Fittings slide over the abutment point to secure the primary support rod with respect to each attachment pin.

Preferably, the primary support rods are metal. However, they may be manufactured from other materials, such as polymeric materials. Preferably, the pair of fittings is a pair of slidable compression fittings. The pair of slidable compression fittings may include a male compression fitting portion and a female compression fitting portion, wherein when the female compression fitting portion is rotated with respect to the male compression fitting portion, the fitting clamps to the primary support rod.

The organizing system may include numerous main supports and at least one secondary horizontal support rod supported by a pair of rod supports. Here, the rod supports are mounted to adjacent primary support rods. The rod supports are preferably slidable along the primary support rods. Each of the pair of rod supports preferably includes an aperture having an axis to receive the primary support rod and, at a right angle to the axis of the aperture, an open groove for receiving the secondary horizontal support rod. The open groove may provide for the secondary support rod to snap in. The head portion and the pin portion of the attachment pins may have the same cross-sectional shapes or different cross-sectional shapes. Rather than being a compression fitting, the fitting may be slidable sleeve held in position by friction or otherwise held in position. Preferably, the primary support rod has a cylindrical cross section.

BRIEF DESCRIPTION OF SEVERAL VIEWS OF THE DRAWINGS

The invention will be described in conjunction with the following drawings in which like reference numerals designate like elements and wherein:

FIG. 6 is a cutaway, side elevation view of a set of end fittings, including primary support rod, fitting and attachment pin, taken substantially along lines 6—6 of FIG. 3;

FIG. 7 is a partial, cutaway, cross-sectional, front elevation view of the organizing system for drawers and cabinets of FIG. 1, taken substantially along lines 7—7 of FIG. 4; and FIG. 8 is a cross-sectional view of a pair of sliding rod supports and their associated secondary horizontal support rod of the organizing system for drawers and cabinets of FIG. 1, taken substantially along lines 8—8 of FIG. 7.

DETAILED DESCRIPTION OF THE INVENTION

Figure 1:
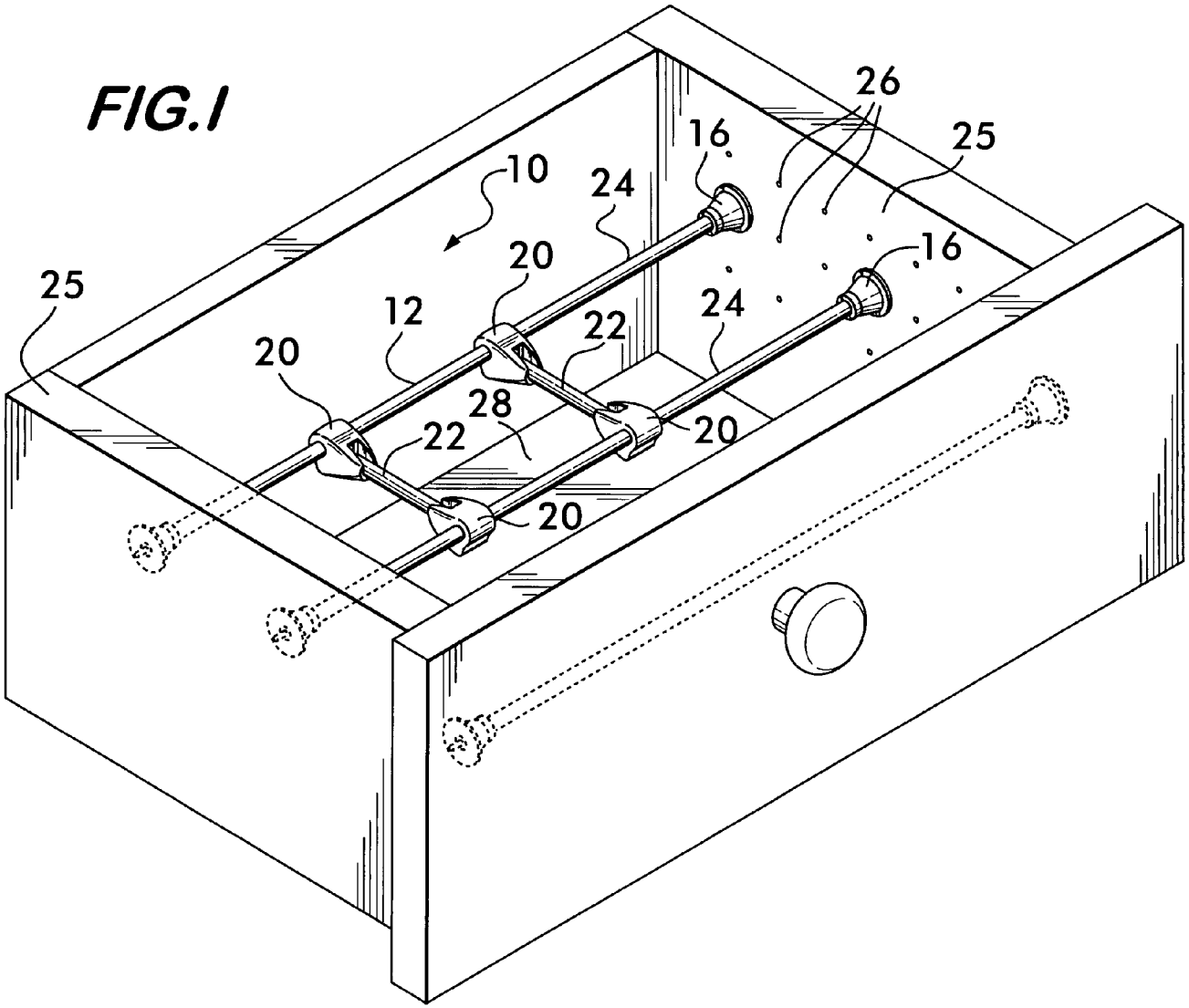
FIG. 1 is an isometic view of a drawer having an example of an organizing system for drawers and cabinets in accordance with one preferred embodiment of the present invention.
Figure 2:
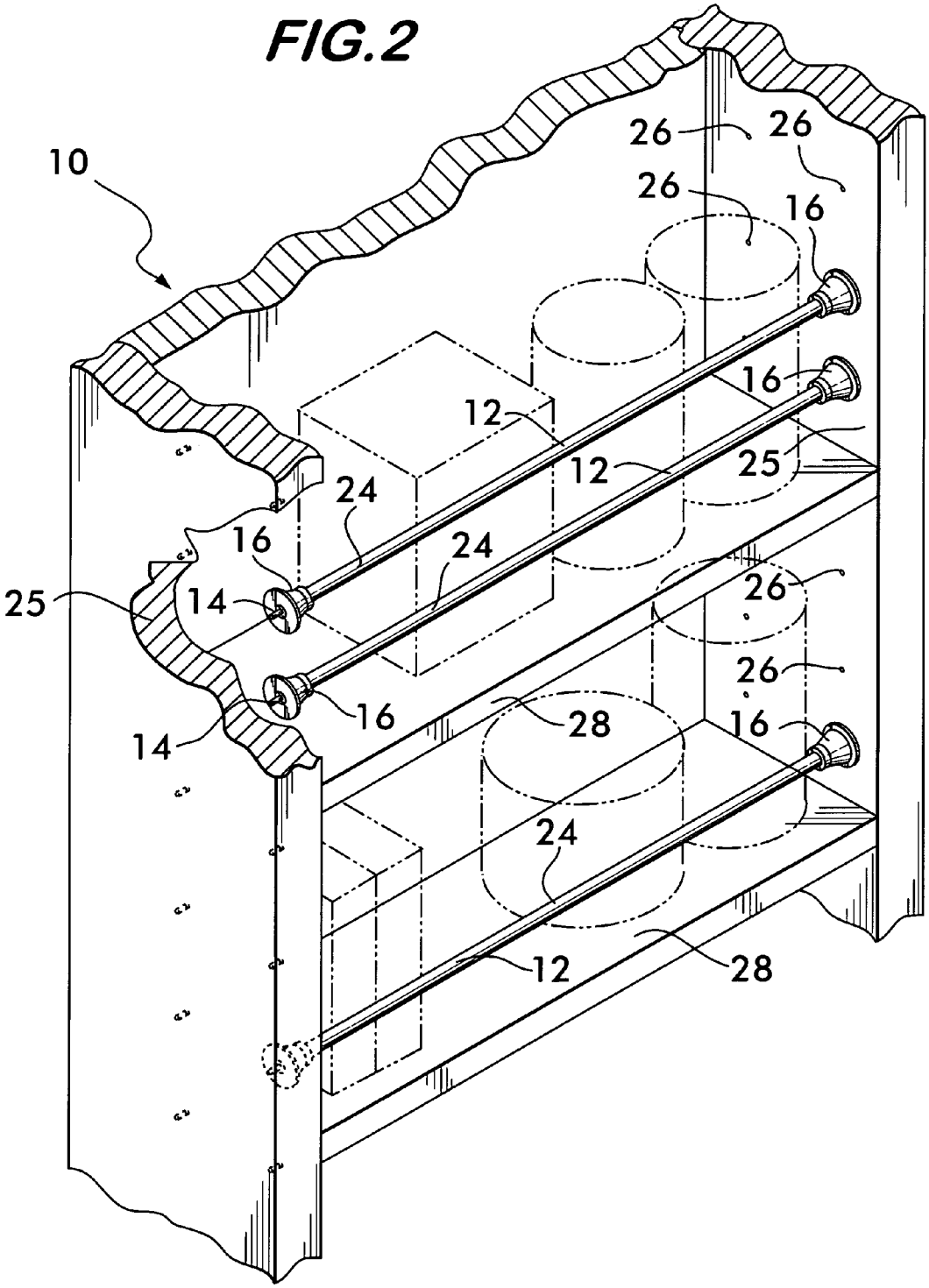
FIG. 2 is an isometric view of a set of shelves having an example of an organizing system for drawers and cabinets similar to that of FIG. 1.
Figure 3:
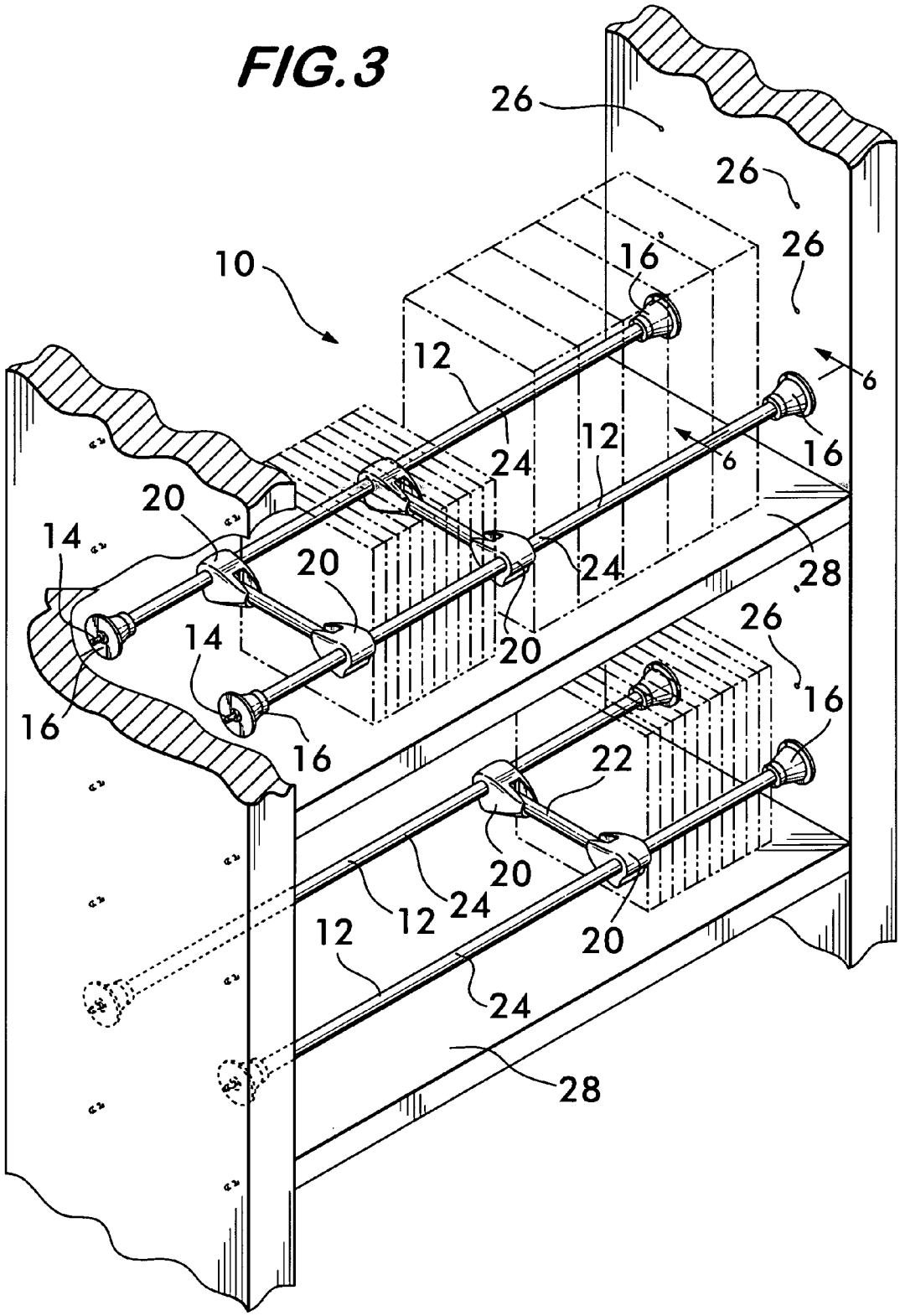
FIG. 3 is an isometric view of another set of shelves having an example of an organizing system for drawers and cabinets similar to that of FIG. 1.

Referring now to the drawings, wherein like part numbers refer to like elements throughout the several views, there is shown in FIGS. 1, 2 and 3 examples of an organizing system for drawers and cabinets 10 in accordance with one preferred embodiment of the present invention. The organizing system 10 includes several main elements including primary support rods 12, such as plated steel or polymeric rods, attachment pins 14 (see, e.g., FIG. 2), and fittings 16, for example, a two-piece compression fitting that includes a male compression fitting portion 16*a* and a female compression fitting portion 16*b*. The organizing system 10 may optionally further include sliding rod supports 20 that are adapted to secure one or more secondary horizontal support rods 22. Each of these elements will be described in further detail below.

Figure 4:
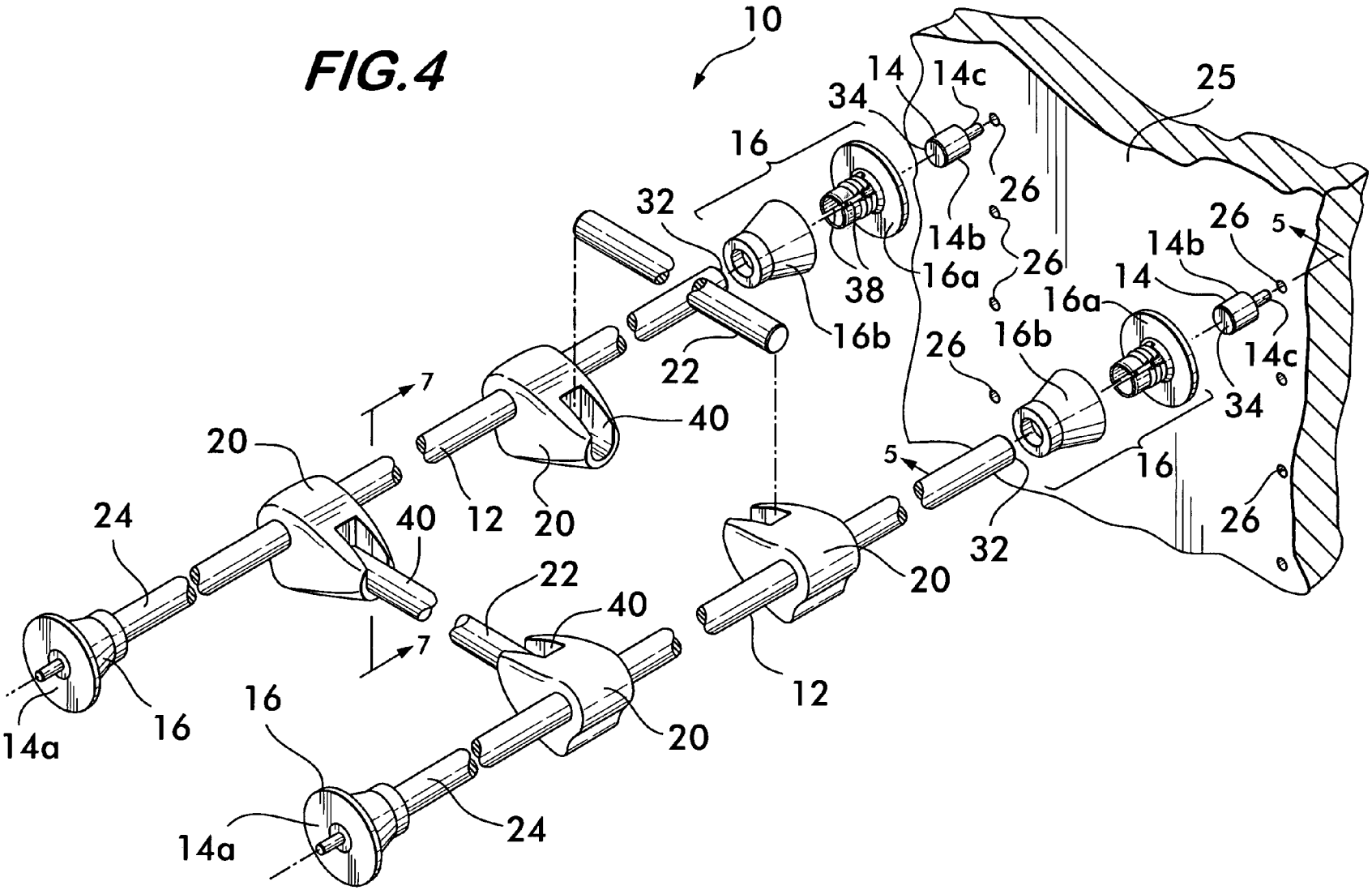
FIG. 4 is an exploded, isometric view of an example of the organizing system, similar to that of FIG. 1.
Figure 5:
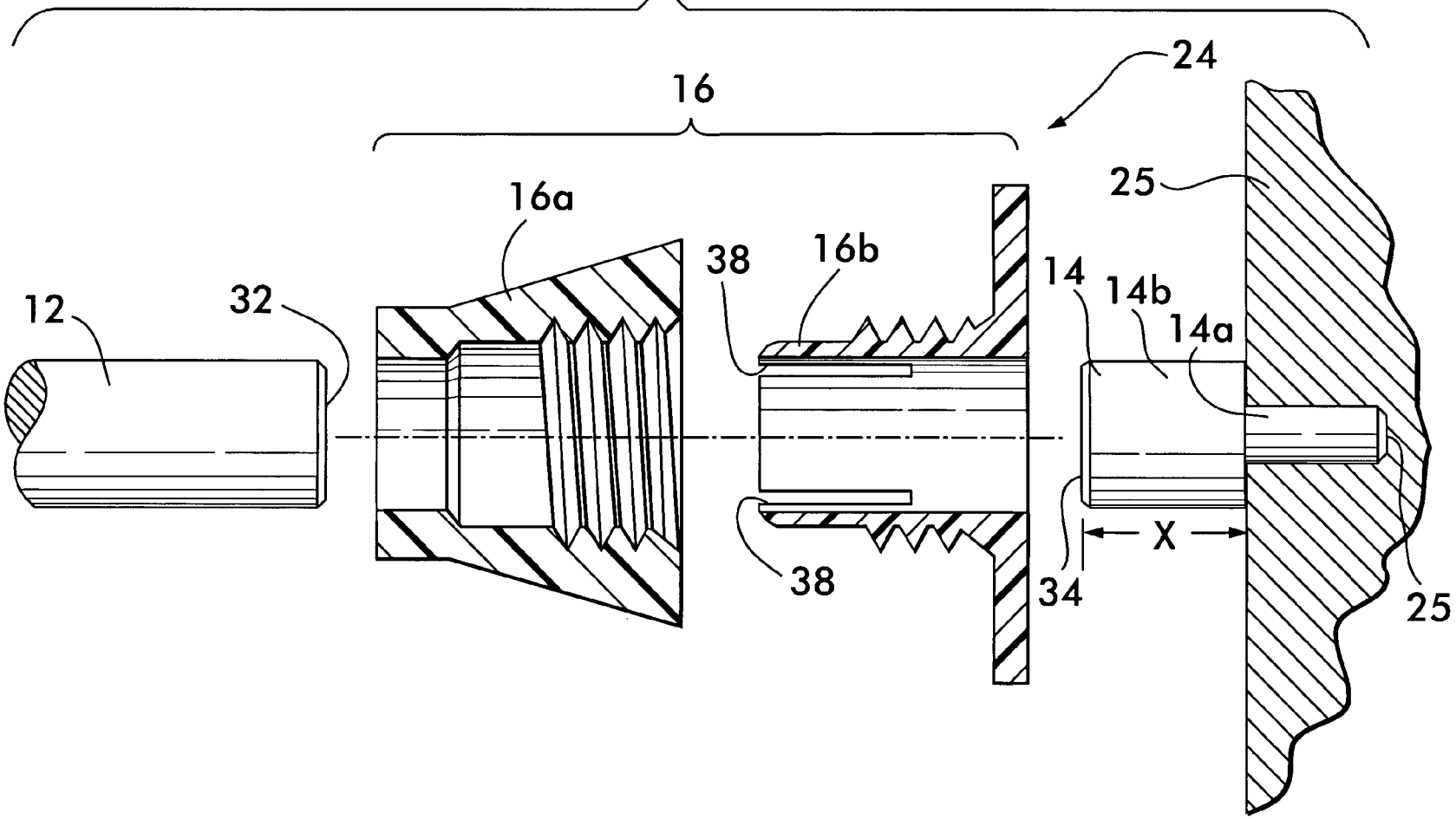
FIG. 5 is an exploded, cutaway, side elevation view of a set of end fittings including primary support rod, fitting and attachment pin, taken substantially along lines 5—5 of FIG. 4.

FIG. 2 depicts an example of the simplest configuration of the present invention where the system 10 uses one or more main supports 24. In FIG. 2, three main supports 24 are shown. FIGS. 4 and 5 show exploded views, depicting the manner in which the parts are assembled. Each main support 24 includes a primary support rod 12, a pair of attachment pins 14, and a pair of compression fittings 16, for example, a two-piece fitting that includes a male compression fitting portion 16*a* and a female compression fitting portion 16*b*.

As can be seen in FIGS. 4 and 5, to install each main support 24, first each attachment pin 14 is inserted into a predrilled, friction-fit hole 25 in a wall 26 (see FIG. 4) on opposing sides of a drawer or cabinet containing a shelf 28. The attachment pins 14 each have a pin portion 14*a* and a head portion 14*b*. The pin portion 14*a* is inserted into the friction-fit hole 25 in the wall. The pin portion 14*a* and the head portion 14*b* may have identical or different cross-sectional shapes. For example, the attachment pin 14 may be of the configuration shown in the figures herein or the attachment pin may be a short cylindrical pin with no discernable head and tail portion. Other cross-sectional shapes may also be used. The primary support rod 12 is sized to securely fit between the head portion 14*a* of each attachment pin 14 as can best be seen in FIGS. 6 and 6A. The primary support rods 12 are preferably available either stock sizes, which are preferably available in numerous standard increments, or are available in a longer length that is then cut to fit by, for example, an installer, prior to installation. For example, if the head height X (see FIG. 5) of the head portion 14*b* of the attachment pins 14 are one-half inch in length and a twenty-four inch main support 24 is desired (i.e., the distance between walls of a drawer or cabinet is twenty four inches), then a primary support rod 12 of approximately twenty three inches in length is required.

Prior to assembly of the main support 24, the pair of untightened fittings 16 is slid onto the primary support rod 12 on each side of the primary support rod 12 adjacent each attachment pin 14. The primary support rod 12 is then aligned between the two attachment pins such that the ends 32 of the primary support rod 12 and the top surface 34 of the head portion 14*a* of the attachment pins 14 abut one another to create an abutment point 36 adjacent each wall 26 (see FIGS. 6 and 6A). The untightened fitting 16, is slid into place over the attachment pin 14, i.e., towards its associated wall, such that the abutment point 36 is located internal to the fitting 16. The female compression fitting portion 16*b* is rotated relative to the a male compression fitting portion 16*a* such that the compression fitting 16 "locks" the primary support rod 12 to the adjustment pins 14 within the tightened fitting 16.

Figure 6A:
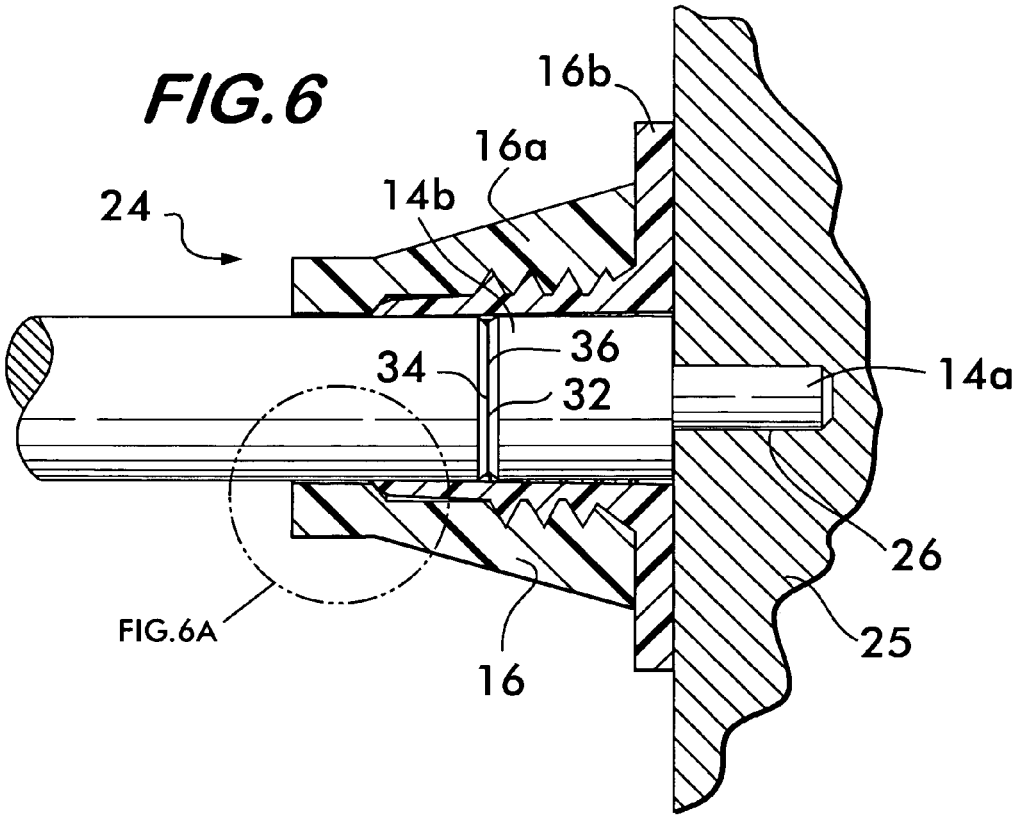
FIG. 6A is an enlarged detail view of the view in FIG. 6 designated as FIG. 6A.
Figure 6A:
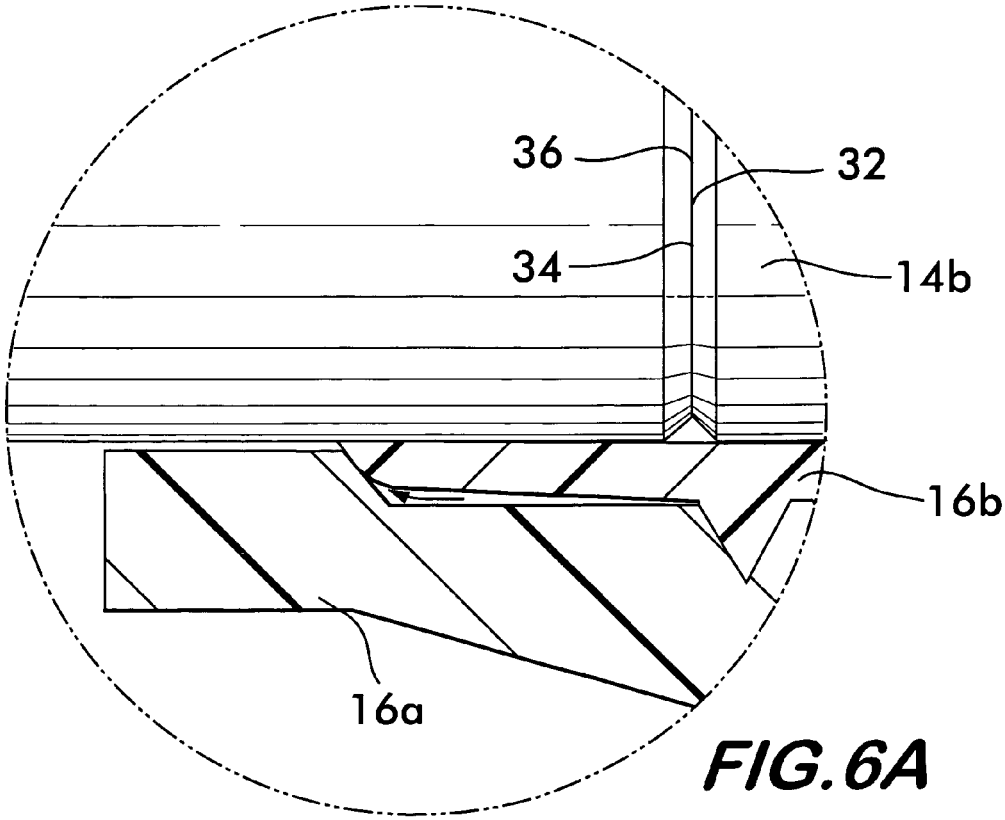

The locking action created by the compression fitting 16*a*, 16*b* is best seen in FIGS. 6 and 6A. The male compression fitting portion 16*a* is threaded in a slightly conical shape such that a screwing down action by the female compression fitting portion 16*a* onto the male compression fitting portion 16*b* causes slots 38 to collapse slightly, thereby creating a clamping effect on (preferably) the primary support rod 12. FIG. 6A clearly depicts the clamping action achieved by a tightened compression fitting 16*a*, 16*b*. The clamping can also be accomplished on the attachment pin head portion 14*a* so long as the abutment point 36 is within the fitting 16.

As can be seen in FIGS. 1, 3 and 4, the organizing system 10 may also include sliding rod supports 20 that are adapted to secure one or more secondary horizontal support rods 22 that are perpendicular to the main supports 24. Here, the sliding rod supports 20 are slid into place onto a pair of adjacent primary support rods 12 prior to assembly of the main supports 24, as described above. Again, FIG. 4, depicts an exploded view which shows the assembly including the secondary horizontal support rods 22 and sliding rod supports 20 with respect to the main supports 24. FIG. 7 depicts the manner in which the sliding rod supports 20 slide along the primary support rods 12, i.e., in the directions of arrows A and B.

Preferably, the sliding supports 20 are of a "snap-in" configuration which provides easy installation of the secondary horizontal support rods 22 onto the primary support rods 12. If sliding rod supports 20 are used, the secondary horizontal support rods 22 are preferably installed as shown in FIG. 8. One of the sliding supports 20 is rotated or the secondary horizontal support rod 22 is lowered (or raised) into position such that the rod 22 is snapped into place in an open groove 40 of sliding rod support 20. The same procedure is accomplished at the opposite end of the rod 22. The snap-in configuration of the open groove 40 of the sliding rod support 20 provides sufficient clearance for the secondary horizontal support rod 22 to be snapped into place with a moderate amount of force due to the flexing of the, preferably polymeric, sliding supports. Once installed, the secondary horizontal support rod 22 and its associated sliding supports 20 may be slid along the pair of primary support rods 12 to which they have been attached. However, a fairly substantial amount of friction may be desired in some cases such that the position of the secondary support rod is held securely. This may be accomplished by adjusting the diameter (or other relevant dimension if a cross section other than circular is used) of primary support rods 12 with respect to the size of the apertures 42 in the sliding supports 20. It is noted that none of the rods discussed herein need be circular in cross section. Other cross-sectional shapes may be effectively utilized.

It is noted that the fittings 16 may be simply in the form of sliding sleeves that cover the abutment point 36 rather than the compression fittings 16*a*, 16*b* described herein. As long as the fittings 16 cover the abutment point 36, and the fitting provide for an adequate amount of friction, the system will be securely locked into place. Additionally, any known fitting other than a compression fitting is also intended to be a "fitting" as described herein.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. An organizing system for attachment to opposing walls adjacent a flat surface, the organizing system comprising:

(a) at least one pair of holes in the opposing walls, wherein the pair of holes are in opposing alignment with one another;

(b) at least one main support, comprising:

(i) a pair of attachment pins, each attachment pin having a head portion and a pin portion, the pin portion of each attachment pin pressed into one of the pair of holes in the walls, the head portion having a cross-sectional shape and a planar top surface, said planar top surface being substantially parallel to the opposing walls;

(ii) a primary support rod having two ends having planar end surfaces and a cross-sectional shape that is substantially the same as the cross-sectional shape of the head portion, said planar end surfaces being substantially parallel to the opposing walls, the primary support rod extending between the top surfaces of the head portions of the pair of attachment pins such that an abutment point is created at each end of the primary support rod between each primary support rod end and the top surface of each attachment pin; and (iii) a pair of compression fittings that slide over the abutment point to secure the primary support rod with respect to each attachment pin, the pair of fittings including a male compression fitting portion and a female compression fitting portion, wherein when the female compression fitting portion is rotated with respect to the male compression fitting portion, the fitting clamps to the primary support rod.

2. The organizing system of claim 1, wherein the primary support rods are metal.

3. The organizing system of claim 1, wherein the primary support rods are of a polymeric material.

4. The organizing system of claim 1, wherein the head portion and the pin portion of the attachment pins have the same cross-sectional shapes.

5. The organizing system of claim 1, wherein the fitting is a slidable sleeve held in position by friction.

6. The organizing system of claim 1, wherein the primary support rod has a cylindrical cross section.

7. The organizing system of claim 1, wherein the organizing system comprises a plurality of main supports and at least one secondary horizontal support rod supported by a pair of rod supports wherein the rod supports are mounted to adjacent primary support rods.

8. The organizing system of claim 7, wherein the rod supports are slidable along the primary support rods.

9. The organizing system of claim 7, wherein each of the pair of rod supports includes an aperture having an axis to receive the primary support rod and, at a right angle to the axis of the aperture, an open groove for receiving the secondary horizontal support rod.

10. The organizing system of claim 9, wherein the open groove provides for the secondary support rod to snap in.

* * * * *